United States Patent [19]

Simond

[11] 4,074,880

[45] Feb. 21, 1978

[54] CLIMBING WEDGE

[76] Inventor: Ludger Simond, Les Bossons, Chamonix, Haute-Savoie, France

[21] Appl. No.: 758,853

[22] Filed: Jan. 12, 1977

[51] Int. Cl.[2] ..... A47G 29/00

[52] U.S. Cl. ..... 248/1

[58] Field of Search ..... 248/1, 216, 317; 24/115, 265 EL, 136 K, 196, 171; 9/46; 294/74, 78; D8/230; 46/25

[56] References Cited

U.S. PATENT DOCUMENTS

| | | | |
|---|---|---|---|
| 3,877,170 | 4/1975 | Bakker | 46/25 |
| 3,946,975 | 3/1976 | Lyman | 248/1 |
| 3,957,237 | 5/1976 | Campbell | 248/1 |

OTHER PUBLICATIONS

Recreational Equipment Inc., 1974 Chocks Labelled "D".

*Primary Examiner*—Robert A. Hafer
*Attorney, Agent, or Firm*—Browdy and Neimark

[57] ABSTRACT

A climbing wedge for use in mountaineering or speleology has the general shape of a hollow prism with a plurality of faces of different dimensions for use in fissures of different widths. Bosses are present, on each of two opposite parallel faces of the wedge, having openings therein for the passage of ropes. Recesses extend from the end of each of the opposite parallel faces to the boss thereon. Accordingly, two or more wedges of the same shape but different dimensions may be inserted into one another, with the bosses of the smaller wedge entering the corresponding recesses of the larger, without the necessity of removing any ropes passing through the bosses.

4 Claims, 4 Drawing Figures

FIG.1
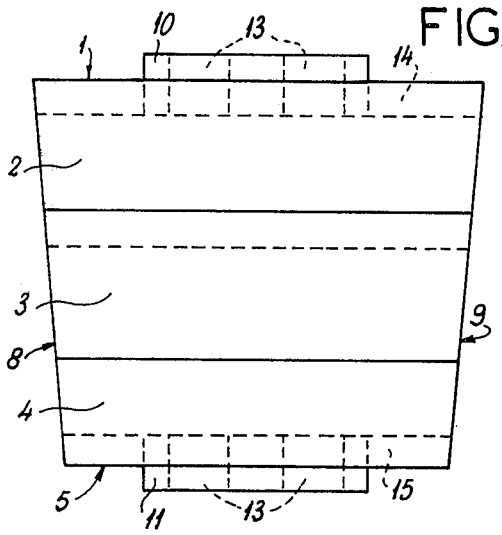
FIG.2
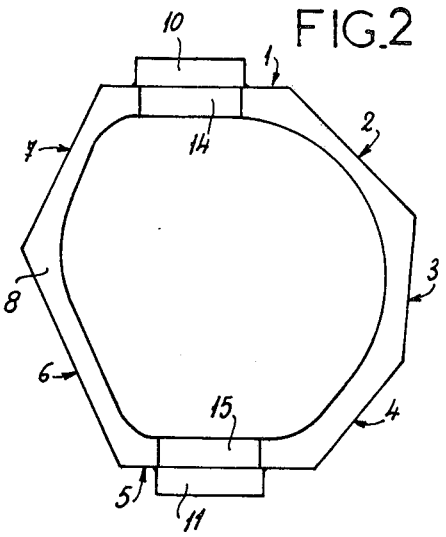
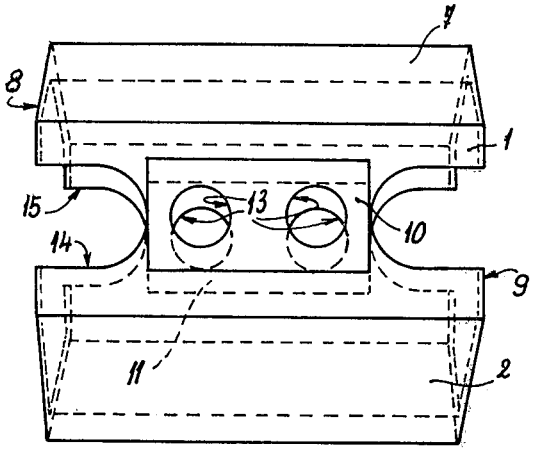
FIG.3
FIG.4
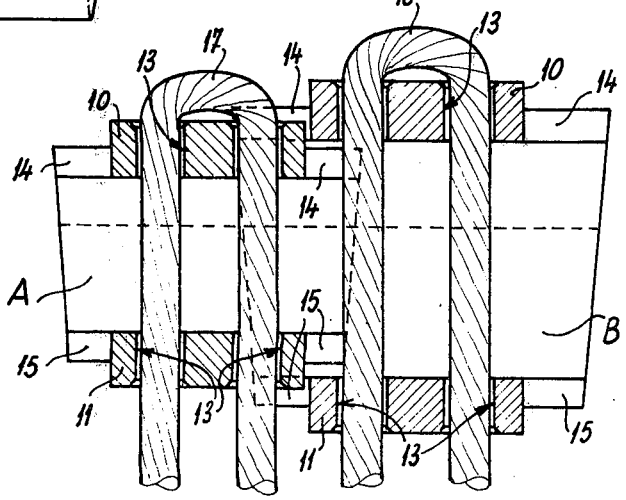

CLIMBING WEDGE

FIELD OF THE INVENTION

The present invention relates to climbing wedges and more particularly to such climbing wedges having the shape of a hollow prism and having a plurality of sides having different angular relationships to one another.

BACKGROUND OF THE INVENTION

To facilitate progression along rock walls in mountaineering or speleology, it is known that pitons and wedges for fastening the various ropes may be used. Pitons are used when the rock has narrow fissures or faults; wedges are used where the fissures or faults are relatively wide.

Thus, climbing wedges are known which have the general shape of a hollow prism and, due to this shape, and to the number and difference in dimensions of their faces, can be used in fissures of different widths. However, in no case is it possible to use the same wedge in fissures with very different widths. Accordingly, the rock climber or caver has to carry a fairly large number of wedges of different dimensions so that he can always have available a wedge adaptable to the fissure he desires to use.

SUMMARY OF THE INVENTION

To overcome this disadvantage, the present invention proposes a wedge of the aforementioned hollow prismatic type whose essential characteristic resides in the fact that the arrangement and shape of at least two such wedges enable them to be fitted into each other in such manner that one wedge cannot rotate and become irremovably wedged into the other, such that it is possible to adapt the total length of the wedge to the width of the fissure.

To achieve this, each wedge has in combination on the one hand at least two bosses appearing on two parallel opposite faces, each having two openings enabling the rope to be passed through, and on the other hand two recesses, situated one on each side of these bosses, enabling the two wedges to fit into one another when the two bosses of the smaller wedge penetrate the two corresponding recesses in the larger wedge. Due to the cooperation of the bosses and recesses, it is impossible for the two wedges to move rotationally or translationally.

By nesting two or three such wedges, it is possible, finally, to obtain a wedge of great length which can be used in relatively wide fissures.

The climbing wedge subject of the present invention also has the feature of comprising a large number of sides, all different from each other, advantageously nine sides, which still further increases the ways in which this wedge can be used.

BRIEF DESCRIPTION OF THE DRAWING

The invention will be well understood with the aid of the description hereinbelow referring to the attached schematic drawing which represents as a nonlimitative example one embodiment of this climbing wedge:

FIGS. 1, 2, and 3 show this wedge in front elevation, side elevation, and in a top view, respectively;

FIG. 4 shows two nested wedges in cross section.

DETAILED DESCRIPTION OF PREFERRED EMBODIMENTS

A wedge according to the present invention has a general hollow prismatic profile; it is formed of seven lateral longitudinal faces and two transverse faces. The lateral faces are designated 1, 2, 3, 4, 5, 6, and 7 and the transverse faces are designated 8 and 9, respectively. The seven longitudinal faces differ from one another in their dimensions; thus, face 4 is the smallest and face 6 the largest. Of these seven longitudinal faces only two are parallel to each other; these are 1 and 5 on which two elongated parallelepipedic bosses appear, designated 10 and 11, respectively. In each of these two bosses two holes 13 are pierced, enabling communication between the outside and the inside chamber of the prism delimited by the wedge. In addition, two recesses are provided in parallel faces 1 and 5, namely 14 for face 1 and 15 for face 5, which open out into the transverse lateral faces 8 and 9 of the wedge and extend to the bosses, 10 and 11, respectively.

It will easily be seen that by reason of its shape, due to the different dimensions of its various lateral longitudinal and transverse faces, a wedge thus designed can be introduced into fissures of somewhat different dimensions.

The wide opportunities for using this wedge are, however, still further improved by the fact that, due to their design, two or more wedges according to the present invention can be fitted into each other. To achieve this it is sufficient for the wedges to be fitted together to have slightly different dimensions and for the inside shape of one wedge to be such that another wedge can be introduced thereinto.

FIG. 4 shows clearly this manner of fitting the two wedges together. The wedge of smaller dimensions A nests inside the wedge with larger dimensions B, whereby bosses 10 and 11 of wedge A penetrate into corresponding recesses 14 and 15 of wedge B. Thus, the two wedges are fitted only partially into each other, and they are immobilized with respect to each other both translationally and rotationally due to cooperation of bosses 10 and 11 of one of the wedges with recesses 14 and 15 of the other wedge.

Thus, it becomes possible to adapt the dimensions of the wedge to the width of the fissure or fault into which the wedge is to be placed. To do this, it is sufficient to nest for example two or three wedges together. It will be understood that under these conditions the mountaineer need only have a set of three wedges to be able to use fissures or faults of very different and relatively large widths. For this purpose the climber is able to vary both the position of the wedge or wedges in the fissure and the number of wedges. If the fissure is of medium width, a single wedge is sufficient, the main point then being to determine the proper position of this wedge in the fissure. On the other hand, if the fissure is wide, two or three wedges can be nested together, and when this has been done it remains only to determine the best position for the wedges inside the fissure.

It should be noted that in all cases it is possible to position the wedge or wedges in a fault or fissure without it being necessary to remove rope or ropes 16, 17 which pass through openings 3 in bosses 10 and 11 of the wedge or wedges.

It will be obvious to those skilled in the art that the present invention is not to be considered limited to the particular design of the climbing wedge shown in the drawings and described in the specification and that various changes may be made without departing from the scope of the invention as defined in the claims.

What is claimed is:

1. A climbing wedge having the general shape of a hollow prism and having fitting means thereon for preventing rotation and jamming into one another when two or more of said wedges of the same shape but different dimensions are fitted together, wherein said wedge has two opposite parallel faces and wherein said fitting means comprises at least one boss on each of said two opposite parallel faces, each of said bosses having two openings for allowing rope to pass through, said fitting means further comprising two recesses on each of said two opposite parallel faces, said recesses on each said face being situated one on each side of said boss, extending from the end side of said face toward said boss, whereby two wedges of the same shape but different dimensions may be fitted together by virtue of the two opposite bosses of the wedge with smaller dimensions penetrating into the two corresponding recesses in the wedge with larger dimensions, without the necessity of removing any ropes passing through the openings in said bosses of said wedges.

2. A wedge in accordance with claim 1 having seven lateral faces, including said two opposite paralel faces, and two transverse faces, each of said transverse faces having an opening therein of a shape generally corresponding to the shape of the outer perimeter of said transverse face, whereby wedges with an outside dimension substantially equal to the inside dimensions of said transverse faces can be fitted thereinto.

3. A wedge in accordance with claim 2 wherein the width of each of said longitudinal faces in the direction between adjoining longitudinal faces, is different.

4. A wedge in accordance with claim 2 wherein said transverse faces are not parallel.

* * * * *